US008042591B2

(12) United States Patent
Rosso et al.

(10) Patent No.: US 8,042,591 B2
(45) Date of Patent: Oct. 25, 2011

(54) PAPER BEADING APPARATUS FOR WALLBOARD CORNER BEADS

(75) Inventors: Aaron Charles Rosso, Chicago, IL (US); Matthew Earle Myers, Naperville, IL (US); Amar Arvind Patel, South Barrington, IL (US); Joseph Z. Wascow, Mundelein, IL (US); Stephen M. Oshgan, Des Plaines, IL (US); Brian A. Retzke, Downers Grove, IL (US); Scott Fong, Causeway Bay (HK)

(73) Assignee: United States Gypsum Company, Chicago, IL (US)

( * ) Notice: Subject to any disclaimer, the term of this patent is extended or adjusted under 35 U.S.C. 154(b) by 724 days.

(21) Appl. No.: 12/036,847

(22) Filed: Feb. 25, 2008

(65) Prior Publication Data

US 2009/0211185 A1 Aug. 27, 2009

(51) Int. Cl.
*B05C 3/12* (2006.01)

(52) U.S. Cl. ..... 156/575; 156/577; 118/404; 118/413

(58) Field of Classification Search ..... 156/574, 156/577, 575; 118/404, 405, 413
See application file for complete search history.

(56) References Cited

U.S. PATENT DOCUMENTS

| | | | | |
|---|---|---|---|---|
| 1,935,060 | A | 11/1933 | Perkins | |
| 2,118,366 | A * | 5/1938 | Spielvogel | 222/81 |
| D173,833 | S | 1/1955 | Brinson | |
| 2,843,953 | A | 7/1958 | Canless | |
| 2,957,449 | A | 10/1960 | Carmichael | |
| D253,278 | S | 10/1979 | Ziaylek, Jr. | |
| D260,039 | S | 7/1981 | de Ruiter | |
| 4,367,692 | A | 1/1983 | Underwood et al. | |
| 4,757,783 | A | 7/1988 | Matheny | |
| D330,772 | S | 11/1992 | Nelson | |
| 5,169,449 | A | 12/1992 | Raught | |
| D338,535 | S | 8/1993 | Robertson | |
| 5,242,495 | A | 9/1993 | Hammond et al. | |
| D347,451 | S | 5/1994 | Kazakowitz | |
| D351,988 | S | 11/1994 | Gotcher | |
| 5,421,886 | A | 6/1995 | Poole et al. | |
| 5,498,287 | A | 3/1996 | Barnfield | |
| D374,582 | S | 10/1996 | Chu | |
| 5,676,793 | A | 10/1997 | Martin et al. | |
| 5,800,894 | A | 9/1998 | Navis | |
| D400,219 | S | 10/1998 | Mercier | |
| D407,831 | S | 4/1999 | Gifford | |
| 5,893,489 | A * | 4/1999 | Giarrante | 222/482 |
| 6,332,325 | B1 * | 12/2001 | Monfort | 62/62 |

(Continued)

OTHER PUBLICATIONS

All-Wall Your Drywall Tools Superstore, 2007-2008 Edition, Catalog Code CAT300C, pp. 56, 57, Kirkland, WA.

(Continued)

*Primary Examiner* — Mark A Osele
(74) *Attorney, Agent, or Firm* — Greer, Burns & Crain, Ltd.; Pradip Sahu; Philip T. Petti

(57) ABSTRACT

A paper beading apparatus, includes a hopper having a body defining a chamber for holding a quantity of joint compound, and having an open upper end, an upper rim, and a lower end; a lid pivotally secured to the body for movement between an open position and a closed position, wherein in the closed position, the lid engages the open upper rim, the lid having a releasably sealable air port; and a base configured for and accommodating the hopper lower end, for receiving joint compound, and for applying the joint compound to a corner paper bead.

16 Claims, 7 Drawing Sheets

U.S. PATENT DOCUMENTS

| | | | | |
|---|---|---|---|---|
| 6,716,486 | B2 | 4/2004 | Kormos | |
| 6,907,908 | B1 | 6/2005 | Weldy | |
| 7,137,231 | B2 | 11/2006 | Harel | |
| 7,214,434 | B2 | 5/2007 | Dalgleish et al. | |
| 7,220,317 | B2 * | 5/2007 | Smythe | 118/404 |
| D556,976 | S | 12/2007 | Liautaud et al. | |
| D571,133 | S | 6/2008 | Liss et al. | |
| 2003/0089058 | A1 | 5/2003 | Kunz et al. | |
| 2004/0187435 | A1 | 9/2004 | Smythe | |
| 2005/0045780 | A1 | 3/2005 | Forshee | |
| 2005/0194393 | A1 * | 9/2005 | Stathoudakis | 220/836 |
| 2006/0108207 | A1 | 5/2006 | Duncan et al. | |
| 2007/0261334 | A1 | 11/2007 | Conboy | |
| 2007/0277475 | A1 | 12/2007 | Smythe | |

OTHER PUBLICATIONS

Structus Building Technologies product brochure, two pages, 2006.

European Search Report, issued by the European Patent Office on Mar. 18, 2011, for co-pending Application No. EP09 00 2550.

* cited by examiner

PAPER BEADING APPARATUS FOR WALLBOARD CORNER BEADS

BACKGROUND OF THE INVENTION

The present invention relates generally to construction using gypsum wallboard, and more particularly, to an apparatus used to apply joint compound to corner paper beads prior to their attachment to joints or corners between adjacent wallboard panels.

Corner beads are elongated, narrow strips of metal or plastic, often having a paper face on one side, and are typically folded or angled along their longitudinal center line to produce a generally v-shaped cross-section. They are made with various angles and corner shapes, including 90-degree angle corners and rounded or so-called "bullnose" corners of various angles. Corner beads are also designed for covering both inside (concave) and outside (convex) corners. For application to an inside corner, joint compound is applied to the outside (convex) faces of an inside corner bead. For application to an outside corner, joint compound is applied to the inside (concave) faces of an outside corner bead. Joint compound is applied to the appropriate faces of the bead, and the bead is then pressed against the corner, with the joint compound forming an adhesive joint between the corner bead and the wallboard corner.

Although wallboard joint compound may be applied to corner beads by hand, this is a time consuming and messy process. Hopper devices have been used to reduce the time needed to apply joint compound to the paper bead and provide for a cleaner process. Such devices typically include a hopper retaining a supply of wallboard joint compound, and a passageway in a bottom of the container where the corner bead is passed through the passageway to receive a coating of joint compound and to provide a guide for locating the corner bead.

Two design criteria of such a device are to increase efficiency and increase cleanliness when applying joint compound to a corner bead. Further, since joint compound generally has a highly viscous property and some compounds set rapidly, it is often difficult to remove unwanted joint compound from the hopper upon completion of a job. Thus, another design criteria of such a device is the ability to readily remove unwanted joint compound.

BRIEF SUMMARY OF THE INVENTION

The above-listed needs are met or exceeded by the present paper beading apparatus, which features a hopper having a lid that provides a seal over the hopper, thus preventing joint compound from inadvertently escaping out of the hopper. A releasably sealable air port is provided on the lid, which allows a batch of unused joint compound to be stored overnight without setting. The hopper also has an obstruction-free floor which allows for easy cleaning and further is supported by a base, which features a set of rings having spaced, stepped fins for accommodating support buckets of varying dimensions, thereby reducing the likelihood of the beading apparatus being inadvertently knocked over, causing joint compound to leak out.

The apparatus also features a single, reversible tray that allows for the application of joint compound to either an inside corner bead or an outside corner bear, depending on the tray's orientation. A mouth at each end of the tray is elongated to reduce dripping of joint compound and to provide a guide for locating the bead in the tray.

The apparatus also features an internal gate having an application portion and a reinforcement portion, each made of distinctive materials. A positioning lug is provided on the gate for engaging a positioning opening on a base, thereby assisting a user in correctly position the gate in the base. Upon assembly, the hopper is positioned over the base and secured thereto.

More specifically, a paper beading apparatus is provided, which includes a hopper having a body defining a chamber for holding a quantity of joint compound, and having an open upper end, an upper rim, and a lower end. Further included is a lid pivotally secured to the body for movement between an open position and a closed position, wherein in the closed position, the lid engages the open upper rim. The lid also includes a releasably sealable air port. Further included is a base configured for and accommodating the hopper lower end, for receiving joint compound, and for applying the joint compound to a corner paper bead.

A second embodiment of the present invention is a paper beading apparatus which includes a hopper having a body defining a chamber for holding a quantity of joint compound and a floor having a depending skirt defining a discharge opening. The apparatus further includes a base configured for receiving the hopper and defining a cavity, a front bead opening, and a rear bead opening at opposite ends of the base and in communication with the cavity, and an inlet chute defining an inlet opening in communication with the discharge opening.

A third embodiment of the present invention is a tray for use in a paper beading apparatus for applying joint compound to a corner bead, the apparatus having a base defining a cavity and having at least one tray track. The tray includes at least two flanges, each flange being generally parallel and equidistant from both a tray upper plane and a tray lower plane, the tray being reversible along a longitudinal axis of the tray and having two positions, an outside bead position wherein the tray has a generally "M"-shape when viewed on end and an inside bead position wherein the tray has a generally "W"-shape when viewed on end, and wherein the at least one tray track each accommodates a corresponding one of the tray flanges when the tray is in either the outside bead position or the inside bead position, the tray being disposed in the cavity.

A fourth embodiment of the present invention is a gate for use with a paper beading apparatus for applying joint compound to a corner bead, the apparatus having a base defining a cavity and at least one gate positioning opening, and a tray being disposed in the cavity. The gate includes at least one gate application edge, a plurality of gate teeth disposed on the at least one application edge, and at least one positioning lug. The gate is disposed in the cavity with the at least one positioning lug engaging the corresponding gate positioning opening, and is arranged such that a bead gap is formed between the at least one gate application edge and the tray. In use, the corner bead is fed through the bead gap such that it makes contact with the gate teeth, the at least one gate application edge defining the amount of joint compound dispensed on the corner bead.

DETAILED DESCRIPTION OF THE INVENTION

Figure 1:
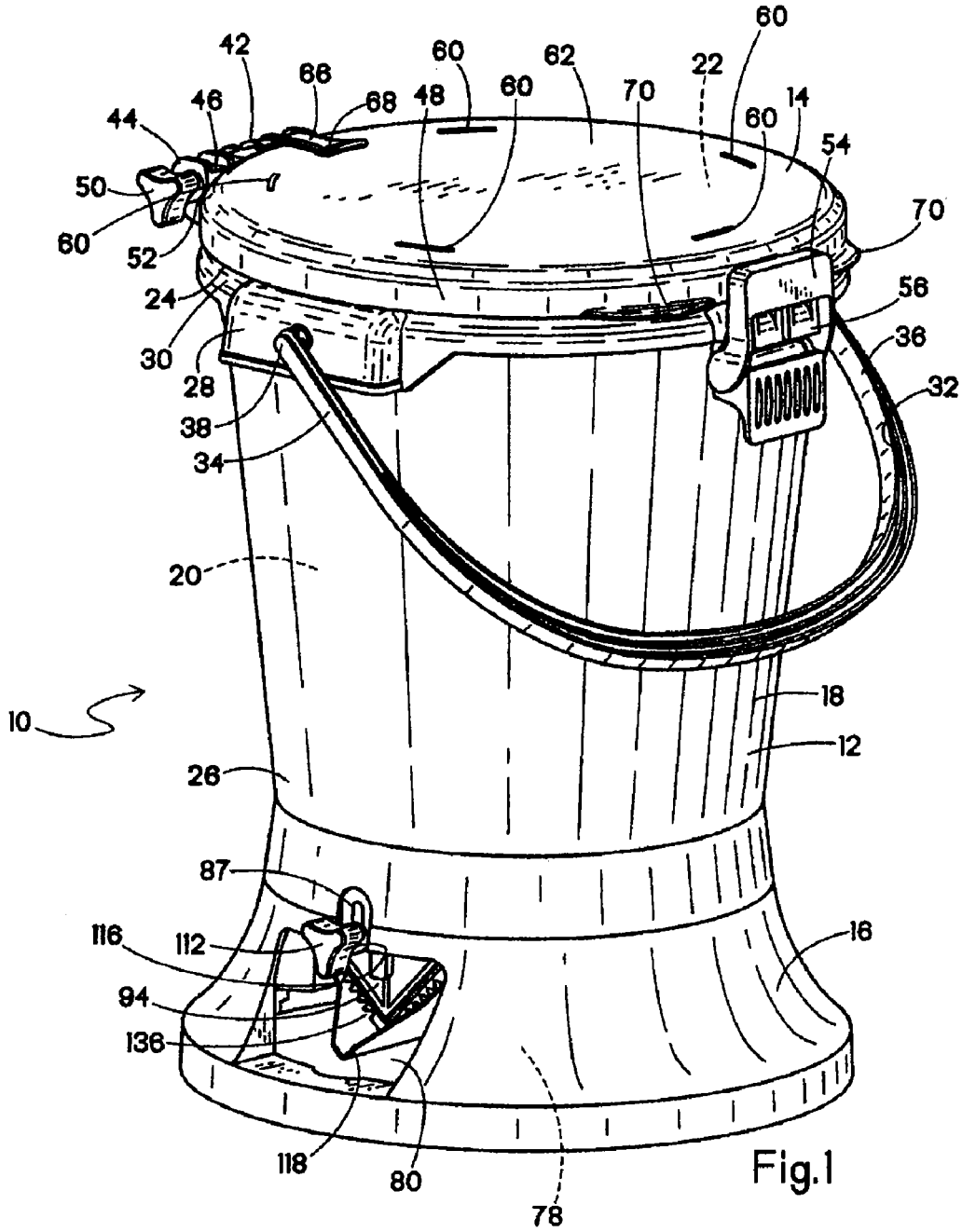
FIG. 1 is a top perspective view of the present paper beading apparatus.
Figure 2A:
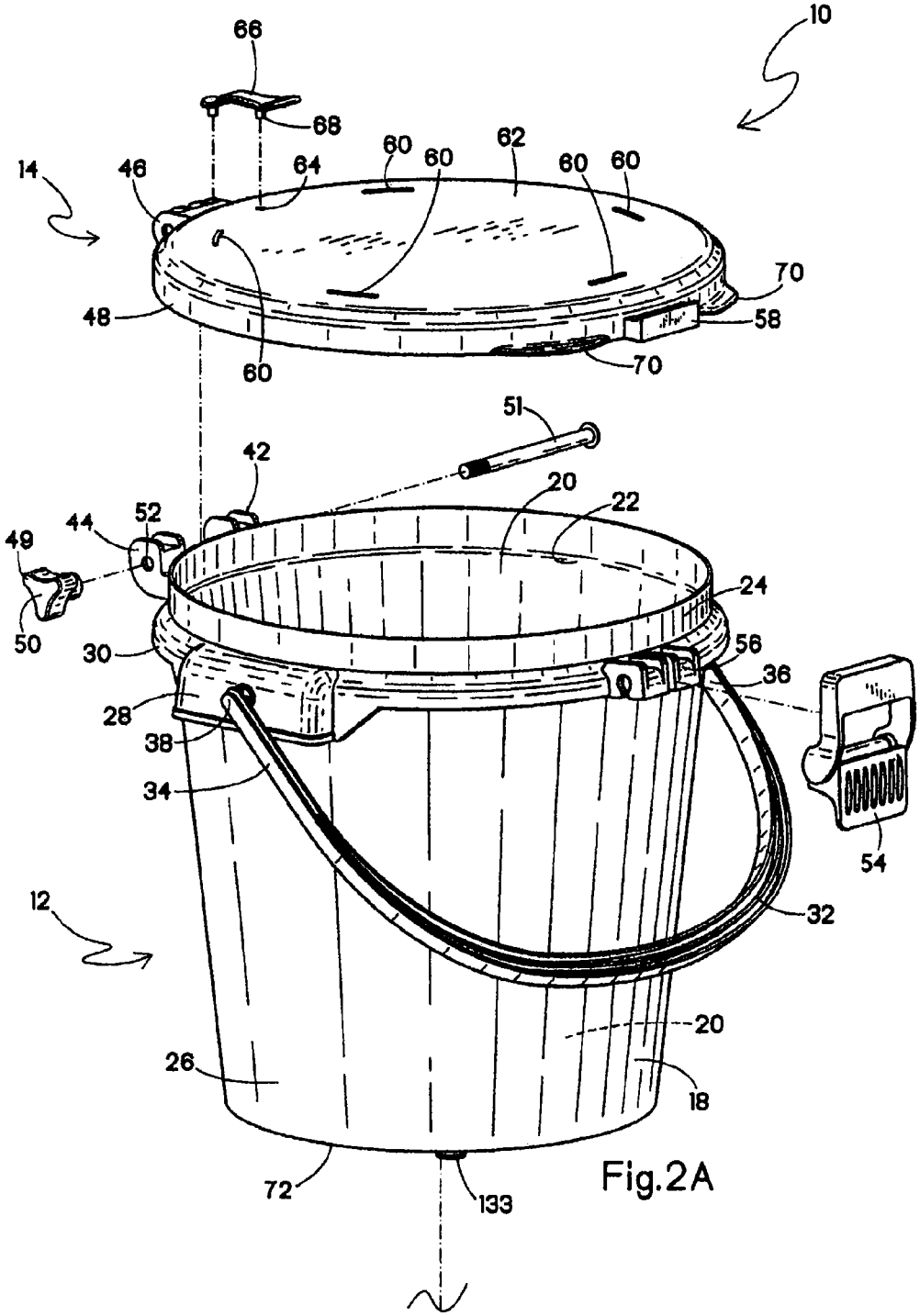
FIGS. 2A and 2B are an exploded top perspective view of the same.
Figure 2B:
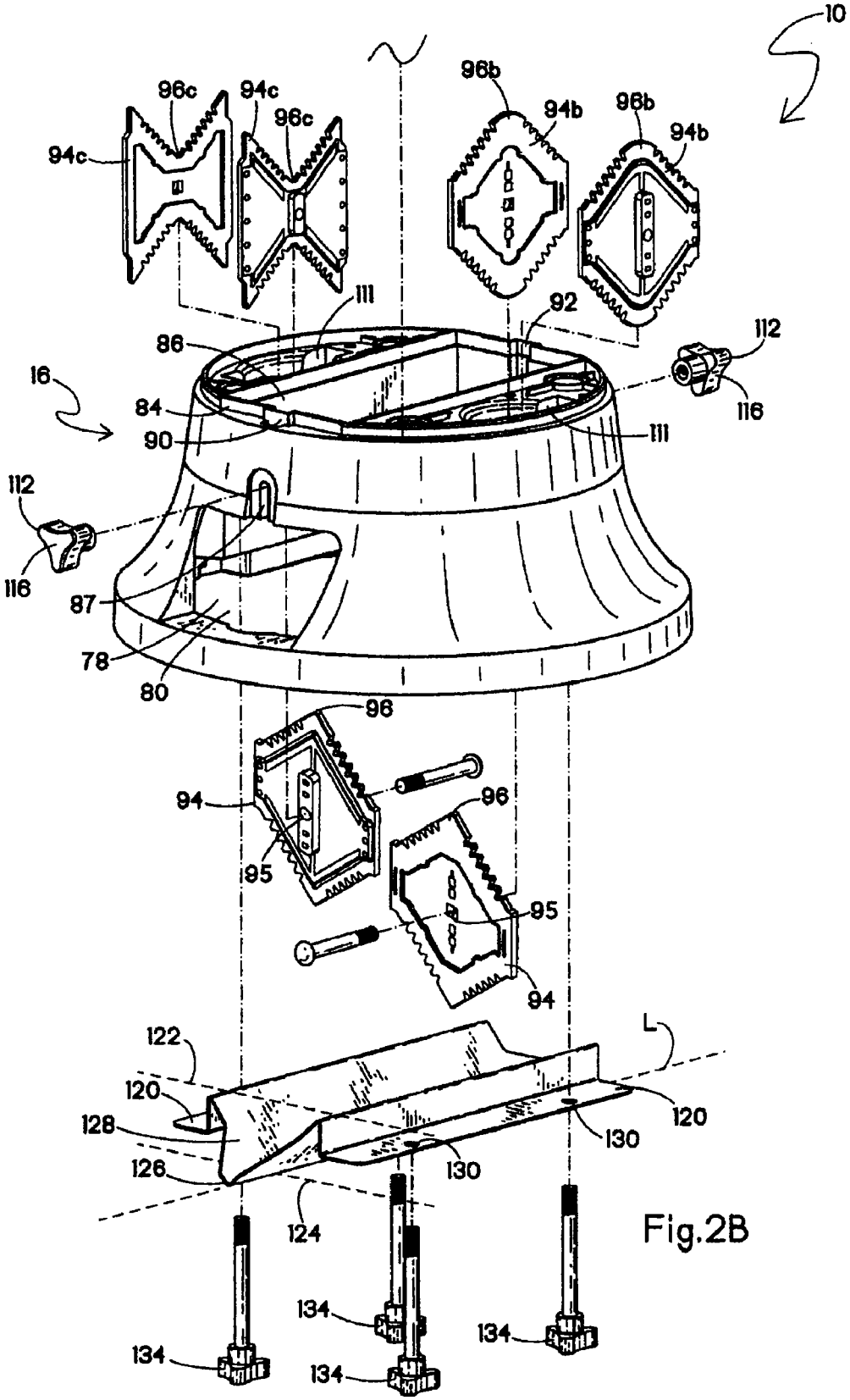

Referring now to FIGS. 1, 2A, and 2B, a paper beading apparatus, generally designated 10 has a hopper 12 with a lid 14, the hopper being attached to a base 16. The hopper 12 has a body 18 defining a chamber 20 for holding a quantity of joint compound. On the hopper 12 is an open upper end 22, an upper rim 24, and a lower end 26. At least two hand holds 28 are disposed on the body 18 near the open upper end 22, for facilitating lifting and/or movement of the paper beading apparatus 10. Preferably, the hand holds 28 are on diametrically opposite sides of the apparatus 10 and are disposed on an annular rib or lip 30, extending radially from a longitudinal axis of the hopper 12. The annular rib 30 is preferably disposed near the open upper rim 24. An alternative way to lift and/or move the paper beading apparatus 10 is provided by way of a handle 32 having two ends, a handle first end 34 preferably being attached to one of the hand holds 28, and a handle second end 36 being attached to the other hand hold. Preferably, each handle end 34, 36 is pivotally fastened to the corresponding hand hold 28 at a pivot point 38.

To reduce the likelihood of joint compound spilling out of the open upper end 22 of the hopper body 18, to prevent unwanted materials from entering the body through the open upper end, and to preserve unused joint compound overnight for use the next day, the lid 14 (FIG. 3) is pivotally secured to the body 18 for movement between an open position and a closed position. In the closed position, the lid 14 engages the hopper upper rim 24, generally forming a seal over the open upper end 22.

An adjustable hinge 42 is constructed and arranged such that the lid 14 pivots on the hinge between the open position and the closed position. The hinge 42 is made up of a hinge body portion 44, preferably extending from the annular rib 30, which generally complements and engages a hinge lid portion 46, preferably extending from an outer rim 48 of the lid 14. An adjustable hinge clamp 49 for varying a clamping force executed on the lid 14 has a clamp knob 50 with a threaded bore and a threaded bolt 51 that passes through at least one hinge fastener opening 52 in each of the hinge body portion 44 and the hinge lid portion 46. Upon tightening the hinge clamp 49, the lid 14 incurs greater resistance in moving between the open position and the closed position, thereby allowing a user to control the ease with which the lid moves about the hinge 42. As such, the user can tighten the hinge clamp 49 sufficiently such that the lid 14 does not freely rotate about the hinge 42, but instead remains in a fixed position. Upon removing the hinge clamp 49, the lid 14 can be completely removed from the hopper 12.

A latch 54, preferably of the over center cam or toggle type and being attached to the body 18 near the open upper end 22, has a latched position and an unlatched position and rotates on a latch attaching extension 56 on the body 18, preferably near the open upper end 22. When the lid 14 is in the closed position and the latch 54 is in the latched position, the latch clamps the lid to the body 18 such that the lid sealingly engages the open upper end 22. Preferably, the latch 54 clamps the lid 14 to the body 18 by grippingly engaging a latch receiving lip 58 on the lid. Variations in the configuration of the latch 54 are contemplated.

At least one, but preferably five lid ribs 60 extend from a top side 62 of the lid 14. When the lid 14 is placed upside down on a generally flat surface, the lid ribs 60, instead of the top side 62, make contact with the surface. As a result, the top side 62 has a reduced likelihood of sustaining wear. Also on the lid 14 is a releasably sealable, preferably circular air port 64. In a preferred embodiment, a stopper 66 is tethered to the lid 14 and has a generally peg-shaped air plug 68 constructed and arranged to releasably seal the air port 64. It is noted that the stopper 66 could alternatively be tethered to the body 18. The lid 14 also has at least one, but preferably two grips 70 extending radially from an edge 72 of the lip 14, which provides the user with an increased surface area for gripping the lid 14 when moving the lid between the open position and the closed position.

Figure 4:
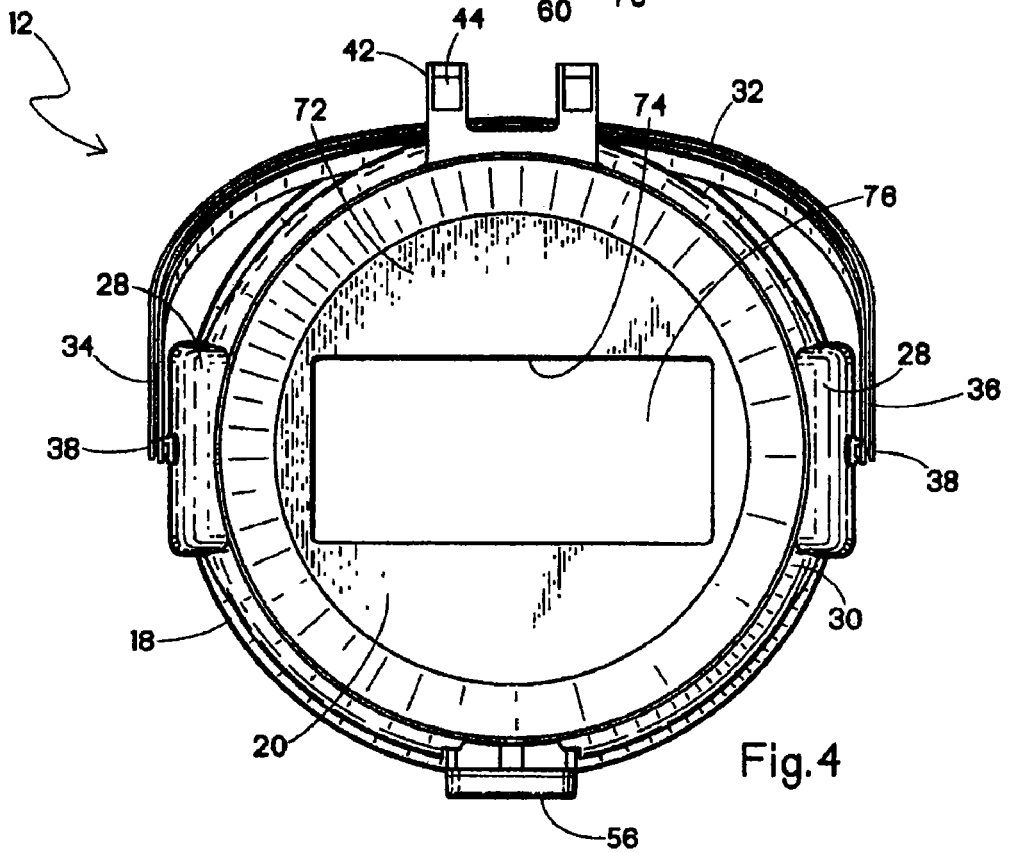
FIG. 4 is a top view of a hopper of the present paper beading apparatus.

Referring now to FIG. 4, a feature of the hopper 12 is a preferably obstruction-free floor 72 having a depending skirt 74 that defines a discharge opening 76. By lacking any obstructions such as fastener heads, the chamber 20 is much easier to clean with a standard taping knife compared to a conventional beading apparatus.

Figure 5:
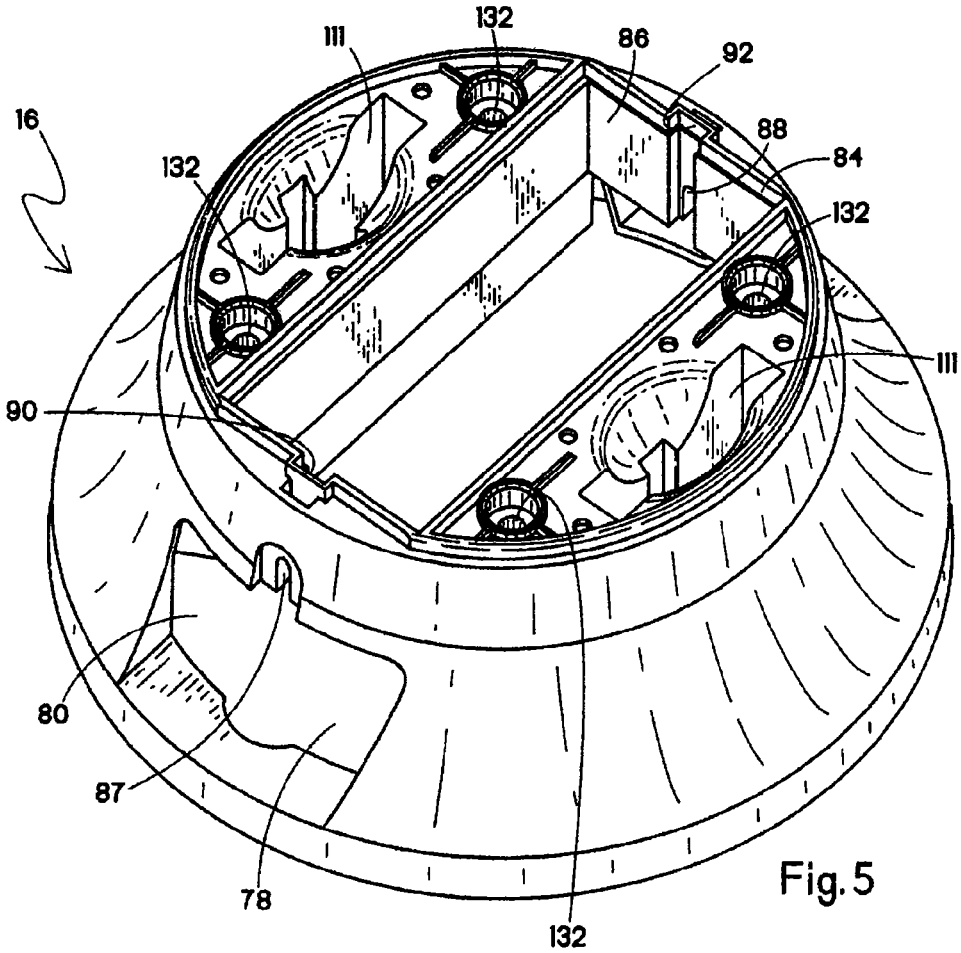
FIG. 5 is a top perspective view of a base of the present paper beading apparatus.

Referring now to FIGS. 2B and 5, supporting the hopper 12 is the base 16 which is configured for and accommodates the hopper lower end 26. The base 16 defines a cavity 78, a front bead opening 80 and a rear bead opening 82 (FIG. 8) at opposite ends of the base and in communication with the cavity, and an inlet chute 84 defining an inlet opening 86 being in communication with the discharge opening 76. Preferably, the inlet opening 86 and the discharge opening 76 are generally rectangular-shaped having generally equivalent dimensions. To facilitate flow of joint compound into the cavity 78, the skirt 74 preferably telescopes into the opening 86.

The base 16 also defines at least two gate adjustment slots, a front gate adjustment slot 87 being adjacent to the front bead opening 80 and a rear gate adjustment slot 88 being adjacent to the rear bead opening 82 (FIG. 5). Further defined by the base 16 are at least two gate positioning openings, a front gate positioning opening 90 being adjacent to the front gate adjustment slot 87 and a rear gate positioning opening 92 being adjacent to the rear gate adjustment slot 88.

Figure 6:
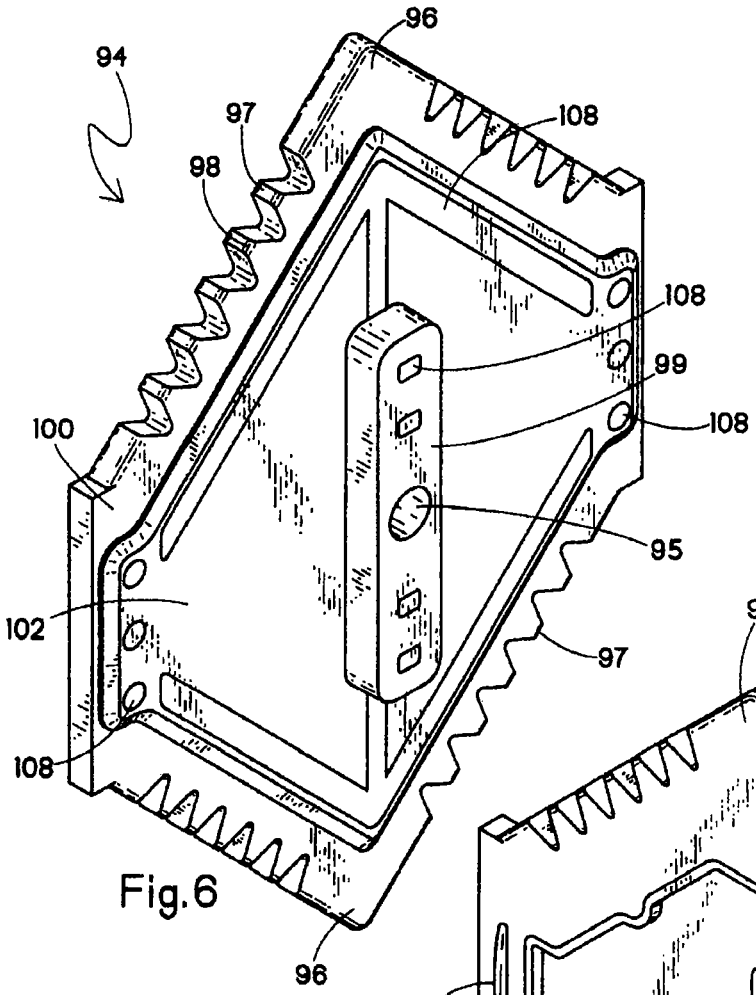
FIG. 6 is a top perspective view of a gate of the present paper beading apparatus.
Figure 7:
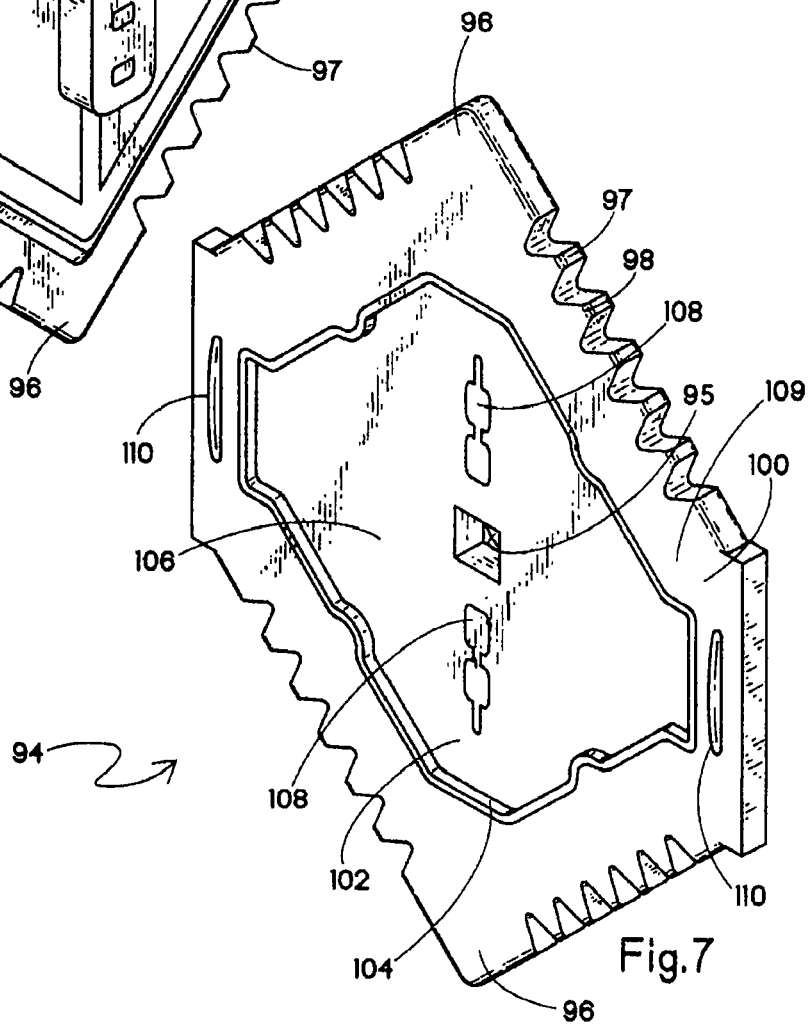
FIG. 7 is a rear perspective view of the gate of FIG. 6.

Referring now to FIGS. 6 and 7, disposed in the cavity 78 is at least one, but preferably two identical gates 94, a first gate near the front bead opening 80, and a second gate 94 near the rear bead opening 82. Each gate 94 has at least one gate fastener opening 95, at least one, but preferably two application edges 96 with a plurality of gate teeth 97 preferably with beveled edges 98 or rounded edges (not shown), and at least one positioning lug 99. Preferably, each gate 94 includes an application portion 100 and a reinforcement portion 102, each portion being made of a different material. In a preferred embodiment, the application portion 100 is made of thermoplastic elastomer material similar to a stiff rubber and the reinforcement portion 102 is made of a relatively hard plastic material, with the two portions being chemically and/or mechanically bonded together to form an integrated piece. A peripheral fence 104 projecting generally normally from a main plane on the reinforcement portion 102 engages a complementary recess 106 in the application portion.

In a preferred embodiment, the application portion 100 has at least one, but preferably several lugs 108 having a variety of shapes, and extending into and mating with the reinforcement portion 102. The lugs 108 provide for mechanical bonding by having a frictional fit and a mating engagement in their corresponding openings in the reinforcement portion 102 (FIG.

6). Chemical bonding is achieved by heating or applying chemical adhesive to the two portions 100, 102. Extending from a rear surface 109 of the gate 94 is at least one, but preferably two gate fins 110 preferably made of a soft plastic material. The base 16 also defines at least one gate storage compartment 111 (FIG. 2B) for conveniently storing spare gates 94. The gate fins 110 engage the inside of the gate storage compartment 111 with a friction fit to reduce gate movement.

Each gate 94 is arranged such that the positioning lug 99 engages the corresponding gate positioning opening 90, 92, the track-like openings being constructed and arranged to allow the gate 94 to be vertically adjustable. Each gate 94 is securable by an at least one elongate threaded gate fastener 112 and a threaded knob 116, with the elongate portion passing though the gate fastener opening 95 at a desired vertical position, and the corresponding gate adjustment slot 87, 88 to engage the knob 116, allowing the gate 94 to be secured at a desired vertical position.

Figure 8:
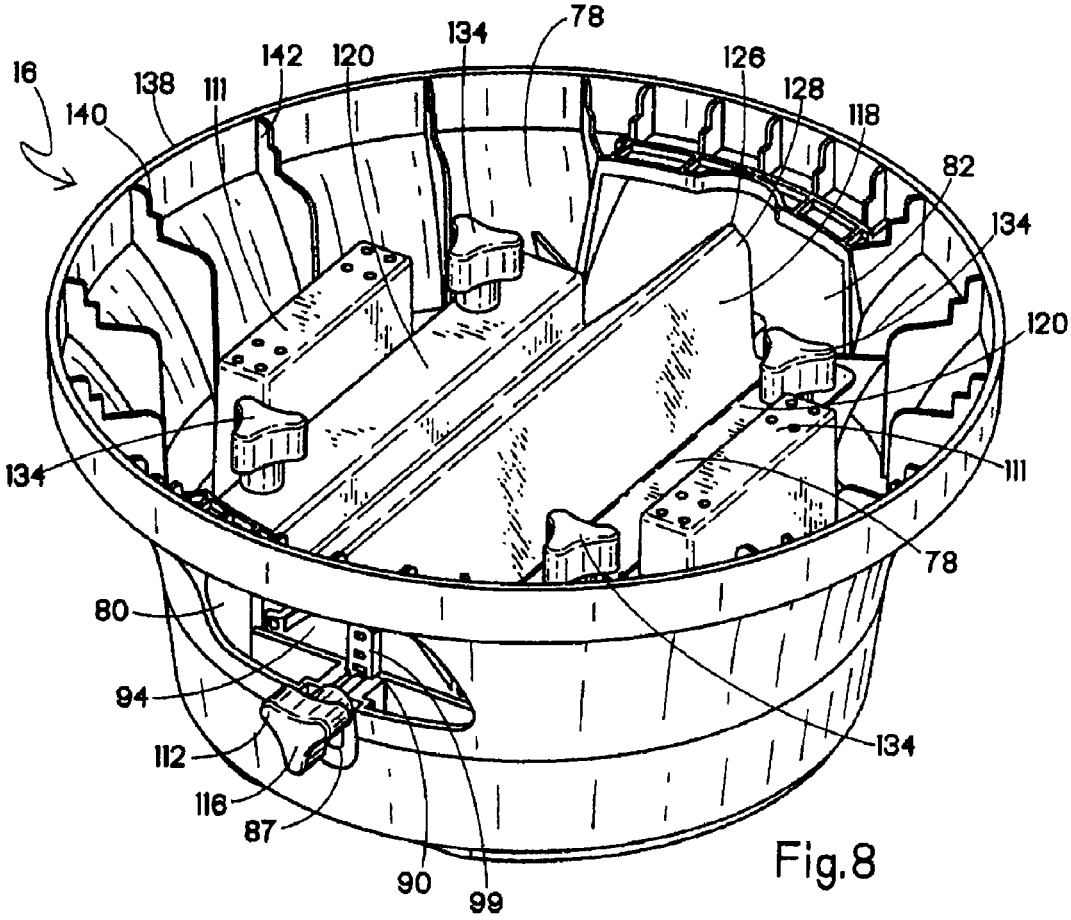
FIG. 8 is a bottom perspective view of a base of the present apparatus.

Referring now to FIGS. 2B and 8, further disposed in the cavity 78 is an elongate tray 118 having at least two laterally extending flanges 120, each flange being generally parallel and equidistant from both a tray upper plane extremity and a tray lower extremity (FIG. 2B). A feature of the tray 118 is that it is reversible along a longitudinal axis of the tray to have two operational positions, an outside bead position where the tray has a generally "M"-shape when viewed on end, and an inside bead position where the tray has a generally "W"-shape when viewed on end. In a preferred embodiment, the tray 118 has at least one, but preferably two mouths 126 located at each tray end 128, extending along the longitudinal axis beyond the flanges 120. Each mouth 126 is elongated to reduce dripping of joint compound and to provide a guide for locating the bead in the tray.

Figure 3:
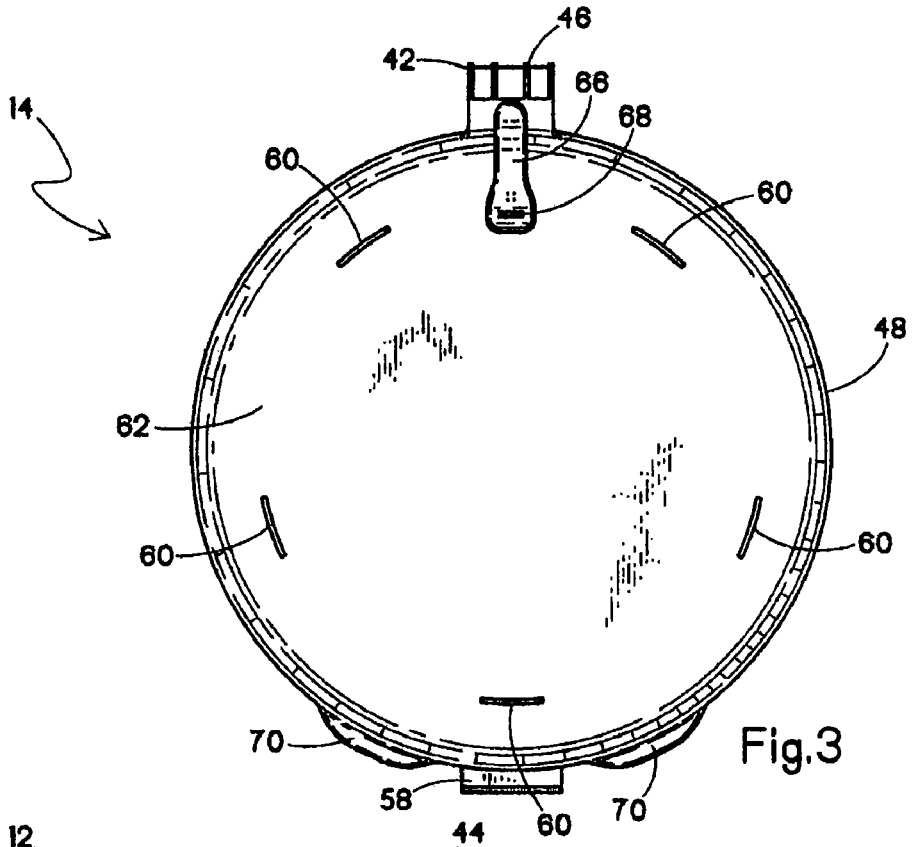
FIG. 3 is a top view of a lid of the present paper beading apparatus.

On the tray 118 is at least one, but preferably four tray fastener openings 130. The base 16 also has at least one, but preferably four base fastener openings 132 (FIG. 5), with the body 18 having at least one, but preferably four bosses 133 (FIG. 2A). At least one, but preferably four tray fasteners 134 are constructed and arranged to fasten the tray 118, in either the outside bead position or the inside bead position, the base 16, and the body 18 together by passing through the corresponding tray fastener opening 130 and the corresponding base fastener opening 132 to engage the corresponding boss 133, which retains a threaded nut (not shown). When the tray 118 is fastened inside the base 16, a bead gap 136 (FIG. 1) is formed between the at least one gate application edge 96 of each gate 94 and the tray. When the gates 94 and tray 118 are properly fastened, the corner bead is able to be fed through the bead gap 136 such that it makes contact with the gate teeth 97, with the gate application edge 96 defining the amount of joint compound dispensed on the corner bead. It is noted and is well-known in the art, that different shaped gate application edges are preferred for different types of corner beading jobs. For example, a gate 94 with a ninety-degree shaped application edge 96 is generally preferred for use with a ninety-degree shaped corner bead. Similarly, a gate 94*b* has a bull-nose shaped application edge 96*b* (FIG. 2B), which is generally preferred for use with a bull-nose shaped corner bead. Also an inside corner gate 94*c* has a distinctive, concave right-angled shape 96*c* (FIG. 3).

Referring now to FIG. 8, while the base 16 can simply be placed on a floor or other generally solid surface when being used, preferably the base has a lower peripheral edge 138 configured for engaging a substrate, wherein the base has at least one ring 140 of spaced, stepped fins 142 disposed inwardly from the peripheral edge for accommodating a support bucket. Preferably, the base has a plurality of rings 140 being radially spaced apart for facilitating engagement with support buckets of varying diameters. Each step defines a landing or engagement point for a support bucket with a different diameter.

While a particular embodiment of the paper beading apparatus has been described herein, it will be appreciated by those skilled in the art that changes and modifications may be made thereto without departing from the invention in its broader aspects and as set forth in the following claims.

The invention claimed is:

1. A paper beading apparatus, comprising:

a hopper having a body defining a chamber for holding a quantity of joint compound, having an open upper end, an upper rim, and a lower end;

a base configured for and accommodating said hopper lower end, for receiving joint compound, and applying the joint compound to a corner paper bead, said base defining a cavity; and an elongate tray having at least two flanges, said tray being reversible along a longitudinal axis of said tray and having two positions, an outside bead position wherein said tray has a generally "M"-shape when viewed on end and an inside bead position wherein said tray has a generally "W"-shape when viewed on end, said tray being disposed in said base cavity.

2. The apparatus of claim 1 further comprising:

at least two hand holds, each disposed on said body near said hopper open upper ends; and a handle having two ends, a handle first end being attached to one of said at least two hand holds and a handle second end being attached to another of said at least two hand holds.

3. The apparatus of claim 1 wherein said apparatus further includes:

a gate having at least one application edge with a plurality of gate teeth; and wherein said gate is disposed in said base cavity and arranged such that a bead gap is formed between said at least one gate application edge and said tray, whereby the corner bead is fed through said bead gap such that the corner bead makes contact with said gate teeth such that the joint compound is dispensed on the corner bead.

4. The paper beading apparatus of claim 1 further comprising a lid pivotally secured to said body for movement between an open position and a closed position, wherein in said closed position, said lid engages said open upper rim, said lid having a releasably sealable air port.

5. The apparatus of claim 4 further comprising a stopper tethered to one of said lid or said body and having a generally peg-shaped air plug constructed and arranged to releasably seal said air port.

6. The apparatus of claim 4 further comprising a hinge constructed and arranged for connecting said lid to said hopper such that said lid pivots on said hinge between said open position and said closed position, said hinge including an adjustable clamp for varying a clamping force executed on said lid.

7. The apparatus of claim 4 further comprising a latch being attached to said body near said body upper end and having a latched position and an unlatched position, wherein when said lid is in said closed position and said latch is in said latched position, said latch clamps said lid to said body, whereby said lid sealingly engages said hopper open upper end.

8. A paper beading apparatus comprising:

a hopper having a body defining a chamber for holding a quantity of joint compound and a floor having a depending skirt defining a discharge opening;

a base configured for receiving said hopper and defining a cavity, a front bead opening, and a rear bead opening at opposite ends of said base and in communication with said cavity, and an inlet chute defining an inlet opening in communication with said discharge opening, wherein said base has a lower peripheral edge configured for engaging a substrate, wherein said base has at least one ring of spaced, stepped fins disposed inwardly from said peripheral edge for accommodating a support bucket;

a vertically-oriented front gate adjustment slot adjacent to said front bead opening;

at least one gate fastener; and a least one gate having a gate fastener opening at least one application edge, and at least one positioning lug, wherein said at least one gate is disposed in said cavity with said at least one positioning lug engaging said front gate adjustment slot and said corresponding, gate positioning opening constructed and arranged so that said gate is vertically adjustable it said opening and securable said at least one gate fastener.

9. The apparatus of claim 8 wherein said base has a plurality of said rings being radially spaced apart for facilitating engagement with support buckets of varying diameters.

10. The apparatus of claim 8 wherein said base further defines at least one gate storage compartment.

11. The apparatus of claim 8 further comprising an elongate tray having at least two flanges, each said flange being generally parallel and equidistant from both a tray upper plane and a tray lower plane, said tray being reversible along a longitudinal axis of said tray and having two positions, an outside bead position wherein said tray has a generally "M"-shape when viewed on end and an inside bead position wherein said tray has a generally "W"-shape when viewed on end, said tray being disposed in said base cavity.

12. The apparatus of claim 11 wherein said base has at least one base fastener opening, said tray has at least one tray fastener opening, and said body has at least one boss, wherein said at least one tray fastener is constructed and arranged to fasten said tray in either said outside bead position or said inside bead position, said base, and said body together by passing through said at least one tray fastener opening, said corresponding base fastener opening to engage said corresponding boss.

13. The apparatus of claim 11 wherein said tray has at least one mouth located at a tray end, extending along said longitudinal axis beyond said at least two flanges.

14. The apparatus of claim 8 where said hopper floor is obstruction free.

15. A tray for use in a paper beading apparatus for applying joint compound to a corner bead, the apparatus having a base defining a cavity and having at least two tray tracks, the tray comprising:

at least two flanges, each said flange being generally parallel and equidistant from both a tray upper plane and a tray lower plane, said tray being reversible along a longitudinal axis of said tray and having two positions, an outside bead position wherein said tray has a generally "M"-shape when viewed on end and an inside bead position wherein said tray has a generally "W"-shape when viewed on end; and wherein the at least one tray track each accommodate a corresponding one of said tray flanges when said tray is in either said outside bead position or said inside bead position, the tray being disposed in said cavity.

16. The tray of claim 15 further including a mouth located at a tray end, extending along said longitudinal axis beyond said at least two flanges.

* * * * *